US012760997B2

(12) United States Patent
Castaneda et al.

(10) Patent No.: US 12,760,997 B2
(45) Date of Patent: Oct. 13, 2026

(54) TARGET SIGHT WITH SENSOR

(71) Applicant: Sig Sauer, Inc., Newington, NH (US)

(72) Inventors: Grover Q Castaneda, Vancouver, WA (US); Richard B. Brumfield, Athens, AL (US); Elbridge J. Lapham, IV, Portland, OR (US); John P. Nichols, Tigard, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 19/172,359

(22) Filed: Apr. 7, 2025

(65) Prior Publication Data

US 2025/0327643 A1 Oct. 23, 2025

Related U.S. Application Data

(63) Continuation of application No. 18/098,005, filed on Jan. 17, 2023, now Pat. No. 12,270,626.

(60) Provisional application No. 63/311,807, filed on Feb. 18, 2022, provisional application No. 63/299,768, filed on Jan. 14, 2022.

(51) Int. Cl.
*F41G 1/393* (2006.01)

(52) U.S. Cl.
CPC ..... *F41G 1/3935* (2013.01)

(58) Field of Classification Search
CPC . F41G 1/3935; F41G 1/30; F41G 1/38; F41G 1/383; F41G 1/387; F41G 1/393; F41G 1/17
USPC ..... 89/41.19, 111, 119, 122, 124, 127, 128, 89/130, 138, 148
See application file for complete search history.

(56) References Cited

U.S. PATENT DOCUMENTS

| | | | | |
|---|---|---|---|---|
| 7,647,721 | B1 * | 1/2010 | Gaber | F41G 1/065 42/129 |
| 2015/0153137 | A1 * | 6/2015 | Newzella | F41G 1/345 42/140 |
| 2015/0184978 | A1 * | 7/2015 | Hedeen | F41G 1/35 42/114 |
| 2016/0091281 | A1 * | 3/2016 | Gwillim, Jr. | F41G 1/345 29/401.1 |
| 2016/0327371 | A1 * | 11/2016 | Teetzel | F41C 23/16 |
| 2018/0299217 | A1 * | 10/2018 | Hedeen | F41A 9/62 |
| 2021/0055536 | A1 * | 2/2021 | DeAngelis | F41G 1/30 |
| 2021/0207928 | A1 * | 7/2021 | Brewer | F41G 1/16 |
| 2021/0223000 | A1 * | 7/2021 | Donahue | F41G 1/14 |
| 2021/0325146 | A1 * | 10/2021 | Thomele | F41G 1/065 |
| 2021/0349300 | A1 * | 11/2021 | Sheets, Jr. | F41G 1/345 |
| 2022/0404121 | A1 * | 12/2022 | Loebig | F41G 1/17 |
| 2023/0003485 | A1 * | 1/2023 | Szapiel | H04N 23/69 |
| 2024/0068778 | A1 * | 2/2024 | Miller | F41G 1/16 |
| 2024/0191973 | A1 * | 6/2024 | Brewer | F41G 1/16 |

* cited by examiner

*Primary Examiner* — John Cooper
(74) *Attorney, Agent, or Firm* — Miller Nash LLP

(57) ABSTRACT

An accessory system for a firearm includes a positionable magnifier, an accessory structured to operate in conjunction with the magnifier, a sensor configured to sense a position of the magnifier, and a processor configured to receive input from the sensor and adjust an operating mode of the accessory based on the input from the sensor. Methods are also described.

25 Claims, 8 Drawing Sheets

TARGET SIGHT WITH SENSOR

CROSS-REFERENCE TO RELATED APPLICATIONS

This application is a continuation of U.S. Non-Provisional application Ser. No. 18/098,005, titled "TARGET SIGHT WITH SENSOR," filed Jan. 17, 2023, which claims benefit of U.S. Provisional Application No. 63/299,768, titled "TARGET SCOPE WITH SENSOR," filed Jan. 14, 2022, and claims benefit of U.S. Provisional Application 63/311,807, titled "TARGET SCOPE WITH SENSOR," filed Feb. 18, 2022, the disclosures of all of which are incorporated herein by reference in their entirety.

FIELD OF THE INVENTION

This disclosure is directed to targeting sights or scopes, and, more particularly, to a targeting sight or scope having a proximity sensor or switch to determine the presence or absence of an accessory device within a line of sight of the sight or scope.

BACKGROUND

Optical sights, such as reflex or red-dot sights, provide a shooter a quick and easy way to sight a target compared to conventional iron sights. Reflex sights are optical sights that include a partially reflecting element on which an aiming light or target is projected. An LED or other light emitter is commonly used as the light source. When the emitter generates its light signal, the projected light reflects from the reflecting element, such as a lens or other optic, and the reflection is seen by the shooter as being superimposed on the target or field of view. This reflection is referred to as a Point of Aim (PoA). In operation, the shooter then aligns the target to the PoA to accurately aim the firearm at the target.

Optical sights have limited sight range, however. Many optical sights allow a shooter to clearly see a target at a distance of, for instance, 50-100 yards, but the target becomes harder to see for the average shooter beyond this distance. Other sights may allow for sighting targets at farther distances, but they still generally have a fixed operating range within which the target is viewable, or the sight effective.

Some modern sights include or may be used with a magnifier that may be selectively enabled. The magnifier may be mounted on a base that allows the magnifier to be positioned so that it appears in the line of sight of the optical sight or may be controllably moved so that it is out-of-line of the optical sight, but still firmly mounted to the firearm. When the magnifier is in place, it magnifies the target image. A difficulty exists, though, in that many sights require additional manual setup on the sight to utilize the magnifier, the additional setup depending on the position of the magnifier.

Embodiments of the invention address these and other limitations of present sights.

DESCRIPTION

Figure 1:
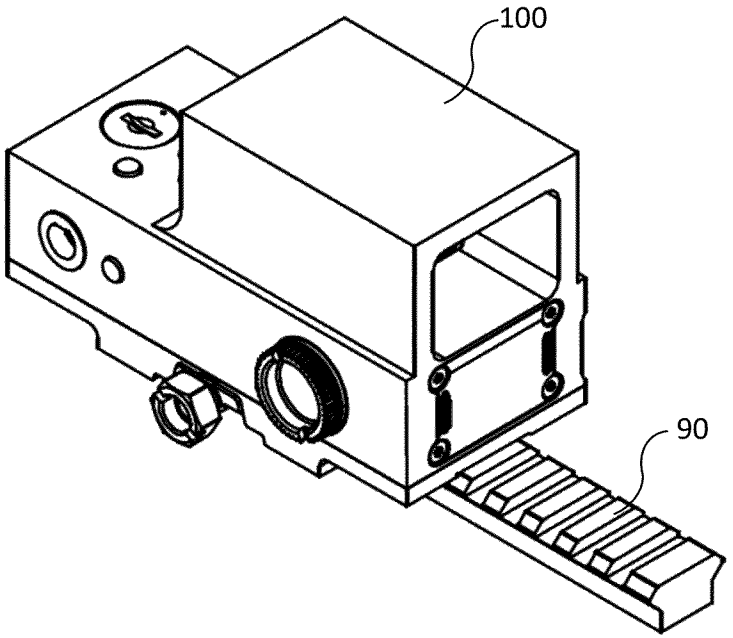
FIG. 1 is a perspective view of a target sight having a sensor mounted on a firearm rail according to embodiments of the invention.

FIG. 1 is a perspective view of an example target sight 100 mounted on a firearm rail 90 according to embodiments of the invention. The firearm, to which the firearm rail 90 is attached, is not illustrated in FIG. 1. Example firearms may include pistols or long rifles, among other types. The target sight 100 may be used in conjunction with an accessory, such as a magnifier, illustrated in FIG. 2. The target sight 100 includes a detector to detect the presence or absence of the accessory in a particular position, such as within a line of sight of the target sight. The example target sight 100 of FIG. 1 is only one example of a target sight for use with embodiments of the invention. Other target sights used in conjunction with embodiments of the invention may differ in appearance or function.

Figure 2:
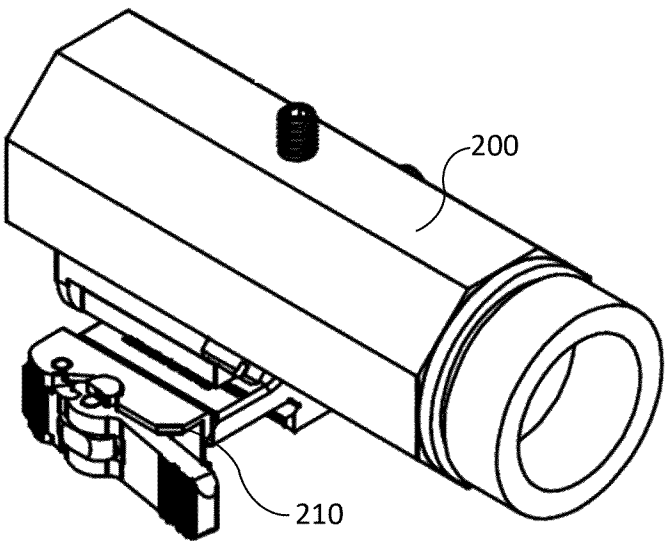
FIG. 2 is perspective view of magnifier that may be sensed by the target sight of FIG. 1, according to embodiments of the invention.

FIG. 2 is a perspective view of an example magnifier 200 that includes a mount 210 by which it can be firmly attach to the rail 90 (not illustrated in FIG. 2). The mount 210 may be a locking mount, as illustrated in FIG. 2, or the mount may attach to the rail 90 through other means.

Figure 3A:
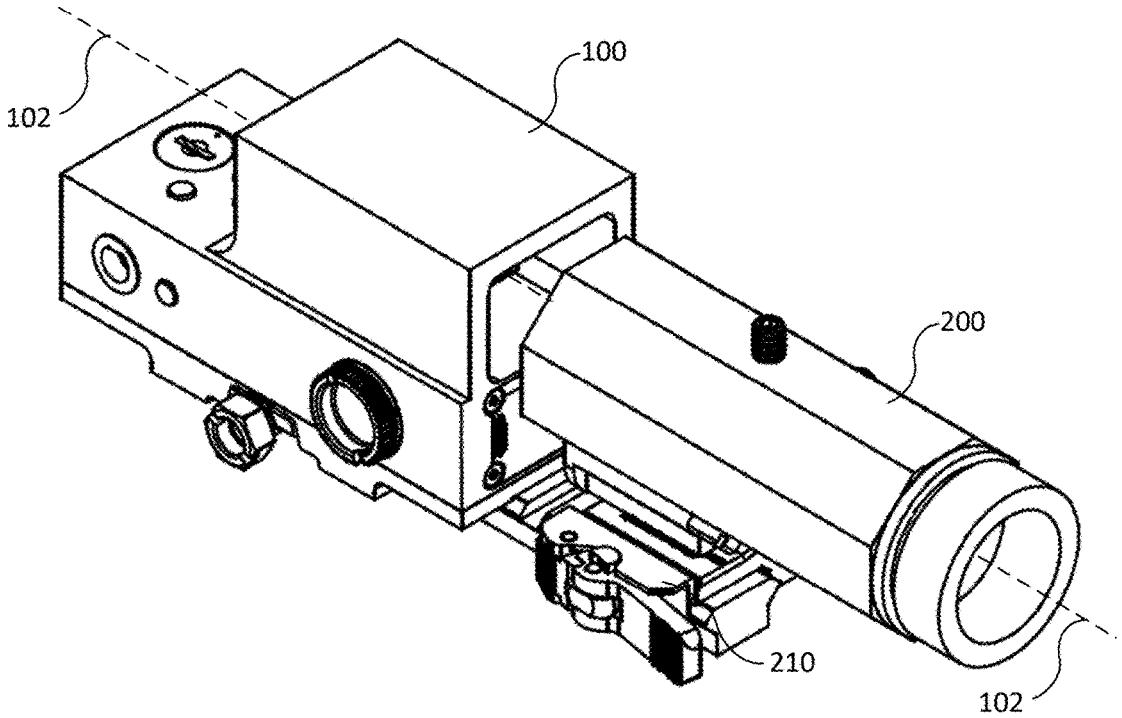
FIG. 3A is a perspective view of the target sight of FIG. 1 and the magnifier of FIG. 2 in a first operating position, according to embodiments of the invention.
Figure 3B:
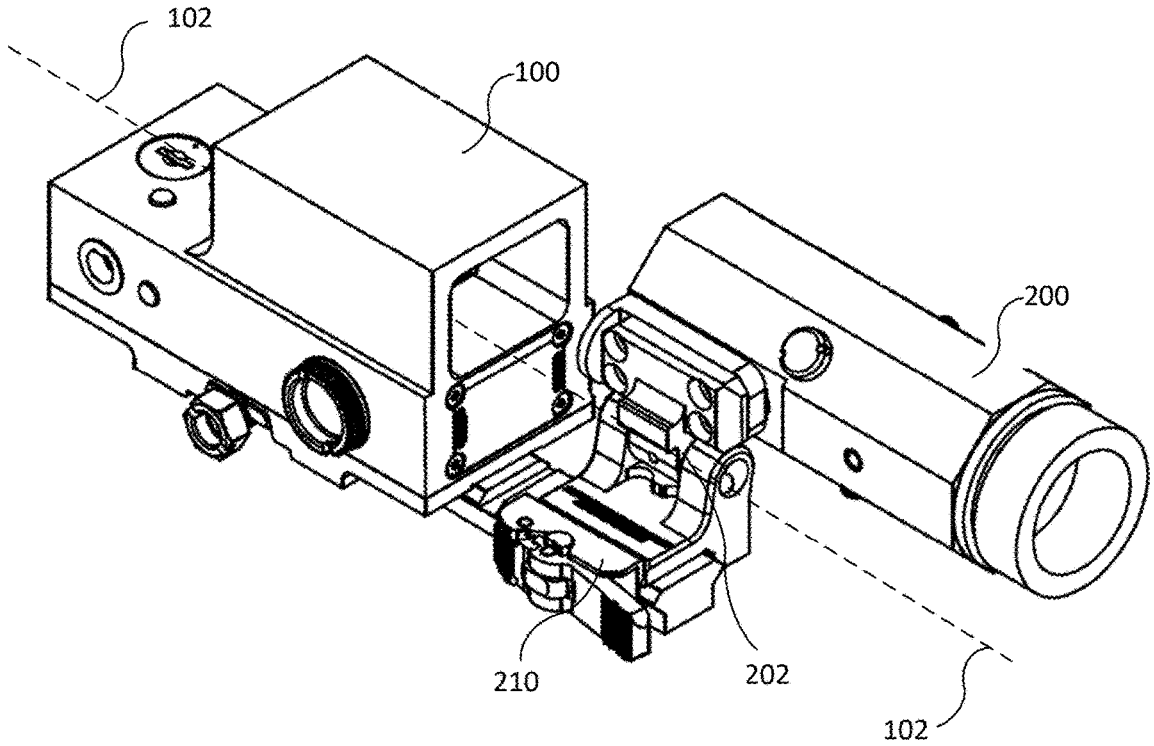
FIG. 3B is a perspective view of the target sight of FIG. 1 and the magnifier of FIG. 2 in a second operating position, according to embodiments of the invention.

With reference to FIGS. 3A and 3B, the magnifier 200 includes a rotatable axis, or hinge 202, about which a movable portion of the magnifier may be positioned to be either in a line of sight 102 of the target sight 100 (FIG. 3A) or positioned to be out of the line of sight 102 of the target sight (FIG. 3B). In both positions, the magnifier 200 is securely mounted to the rail of the firearm through the mount 210. Having such a positionable magnifier 200 allows the shooter to easily select between using the target sight 100 either with or without the magnifier by moving the position of the magnifier. When the magnifier 200 is within the line of sight 102 of the target sight 100, as illustrated in FIG. 3A, the shooter views a magnified view of the target, while still being able to use the target sight. When the magnifier 200 is outside the line of sight 102 of the target sight 100, as illustrated in FIG. 3B, the shooter directly views the target through the target sight, without any further magnification provided by the magnifier. The shooter may use the system as illustrated in FIG. 3A for a target within the range of the target sight 100 itself, while the shooter may use the system as illustrated in FIG. 3B for a target that is further away from the shooter, and outside the effective range of the target sight without supplemental magnification. Although the magnifier 200 is one embodiment of a magnifier used with a target sight 100, other types of magnifiers, or other types of positioning elements on a magnifier may be used without losing the ability from being used with embodiments of the invention. Also, although this description is presented with an example of a magnifier being the accessory sensed by the sight 100, embodiments of the invention may operate to detect other types of accessories, such as second sights, lights, lasers, night vision sights, night vision scopes, and other accessories.

Embodiments of the invention include a sensor or switch to automatically sense the position of the magnifier 200. Then, based on the functional position of the magnifier 200, the target sight 100 may be adjusted, or configured, to an appropriate operating mode, described in further detail below.

Figure 4:
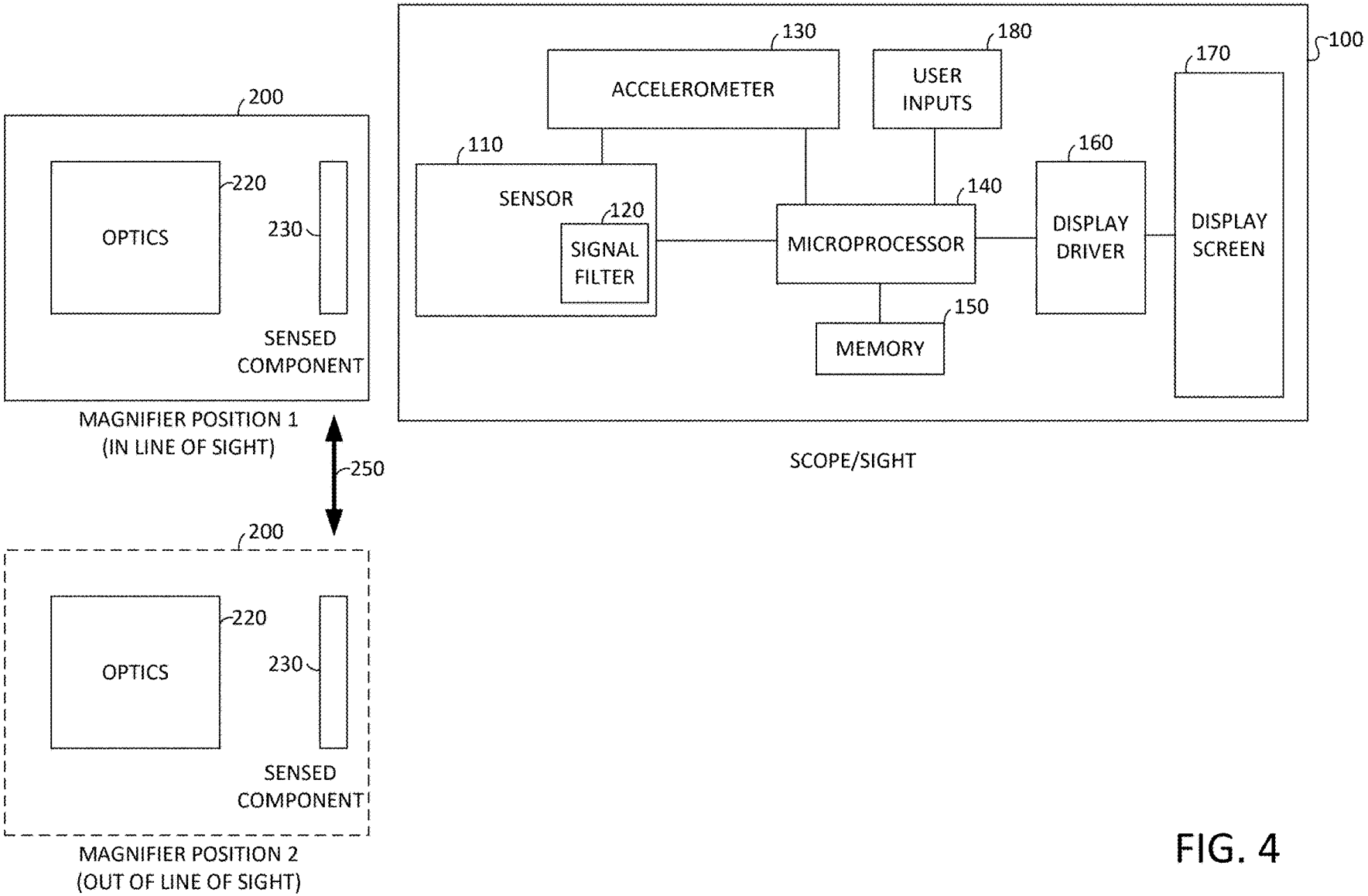
FIG. 4 is a block diagram illustrating example components of a target scope with sensor according to embodiments of the invention.

FIG. 4 is a block diagram illustrating example components of a target scope or sight with sensor according to embodiments of the invention. In FIG. 4, the scope, or sight 100 is illustrated along with the magnifier 200. A portion of the magnifier 200, as shown by the arrow 250, may be moved between an operating position and a storage position. When in the operating position, a portion of the magnifier 200 is placed within the line of sight 102, such as illustrated in FIG. 3A. This position is also referred to as Position 1. In this Position 1, the target is magnified by the magnifier 200 to operate in conjunction with the sight 100. Alternatively, when not being used by the shooter, the magnifier 200 may be moved to the storage position out of the line of sight of the sight 100, such as illustrated in FIG. 3B. This storage position of the magnifier is referred to herein as Position 2. In the Position 2, the sight 100 operates without the magnification properties of the magnifier 200. Typically the shooter manually positions the magnifier 200 in either Position 1 or Position 2, but in some embodiments an automatic positioning system may be used to position the magnifier in the desired position.

The magnifier 200 includes optics 220, which may be one or more lenses to magnify the target, as described above. In some embodiments, the magnifier 200 also includes a sensed component 230, which allows the sight 100 to sense the position of the magnifier. In other embodiments, as described below, the sight 100 is able to determine the position of the magnifier without a need for the magnifier 200 to include a separate sensed component 230.

The sight 100 includes a sensor 110, which senses the position of the magnifier 200. In some embodiments the sensor 110 is a proximity sensor, which determines whether the magnifier 200 is proximate the sensor 110. In one embodiment the proximity sensor is an inductive sensor, and the sensed component 230 of the magnifier 200 is a metallic component. The metallic component may be added specially to the magnifier 200 as the sensed component 230, or the inductive sensor may be able to sense metal already present in the magnifier, such as in a metal housing. In some embodiments the sensed component 230 is small block of metal, such as aluminum or steel that is integrated within the body of the magnifier 200. In other embodiments the sensed component 230 may be attached to the outside of the magnifier. In yet other embodiments, the sensed component may be attached to the mount 210 (FIG. 2).

If the sensor 110 is an inductive sensor and the magnifier 200 or mount 210 includes metal to be sensed, moving the magnifier from the Position 2 to the Position 1, or vice-versa, will create a small electrical signal that may be detected by the sensor 110. The signal may be filtered through an optional signal filter 120 as described below. An accelerometer 130 may also be present in the sight 100 and may be used as an input to the sensor 110 or as an input directly to a microprocessor 140. The sensor 110 may additionally use the input from the accelerometer 130 before providing a signal to the microprocessor 140, also as described below.

A sense signal from the sensor 110 is passed to the microprocessor 140, which determines what action to take in the sight 100 based on the sense signal. The microprocessor 140 is coupled to memory 150, which may include instructions or operations for the microprocessor 140. Although illustrated as a separate component, the memory 150 may be integrated within the microprocessor 140 or may be present elsewhere within the sight 100.

The microprocessor 140 also accepts inputs from one or more user inputs 180. Such user inputs 180 may include buttons, switches, knobs, etc. through which the user controls the operation or setup of the sight 100. In some embodiments the user inputs 180 may be received through a wired or wireless connection, and may be generated by a separate device, such as an application running on a mobile phone or other computing device. The shooter may use the user inputs 180 to control the operation of the sight 100, such as controlling brightness, and/or changing reticle types or other features of the sight, etc. The shooter may also use the user inputs 180 to pre-select how the sight 100 operates depending on the sensed position of the magnifier 200.

The microprocessor 140 may also control a display driver 160 to drive a display screen 170, which is visible by the user on the sight 100. The display screen 170 may be an active matrix display, such as an OLED or other display. In some embodiments, the display screen 170 is a lens that reflects back an image or aiming reticle to the user. The display driver 160 may be integrated into the microprocessor 140, the display screen 170, or elsewhere in the sight 100. In some embodiments the display screen 170 does not need a separate display driver 160. The memory 150 may store one or more reticles, or other controllable images that will ultimately be shown to the user on the display screen 170.

Although many components are illustrated as being contained within the sight 100 of FIG. 1, not all components are necessary for operation. In some cases the function of one or more of the illustrated components may be performed by other components, such as the microprocessor 140.

In operation, when the magnifier 200 is moved from Position 2 to Position 1, the sensor 110 creates a sense signal that may be used to control operation of the sight 100. If the sensor 110 is an inductive sensor, moving the magnifier 200 from Position 2 to Position 1 creates an electrical signal, referred to herein as a raw signal. In a simple embodiment, the sensor 110 generates and sends this raw signal to the microprocessor 140, which may take an action based on the received raw signal. In one embodiment the microprocessor 140 selects a different image to be displayed on the display screen 170 based on receiving the raw signal. For instance, a first reticle may be presented on the display screen 170 when the magnifier 200 is in Position 1, while a second reticle may be presented on the display screen 170 when the magnifier is in Position 2. The system is able to sense the change in position and automatically change the screen without intervention from the user. In more detail, when the microprocessor 140 receives the signal from the sensor 110, the microprocessor may select the appropriate reticle, which is one of a number of reticles stored in the memory 150. The different reticles may be stored in different addresses within the memory 150, so selecting the appropriate reticle may be accomplished by instructing the display driver 160 which address contains the selected reticle. The display driver then causes the display screen 170 to show the reticle stored at the particular address. Other variations of selecting different screens or reticles based on a position of the magnifier 200 are possible and within the scope of one having skill in the art.

In some embodiments, the user may pre-select which reticles are to be shown on the display screen 170 based on various positions of the magnifier 200 in a setup process using the user inputs 180, or using other methods.

Although the specific example of selecting a different reticle based on the position of the magnifier 200 has been described, the microprocessor 140 may use the raw signal to control any operation capable by the sight 100. For instance, the user may set up the sight 100 to turn on or turn off a particular indicator on the display screen 170 based on the position of the magnifier 200, which is determined based on the raw signal. One such indicator could be an image to alert the user of the position of the magnifier 200, so the user does not have to take his or her eyes from the sight 100 to determine the position of the magnifier. In another embodiment the sight 100 may further modify a brightness level of the display screen 170, or element presented on the display screen based on the position of the magnifier.

In other embodiments, the sensor 110 may use the raw signal to generate a position signal, which may be used by the microprocessor 140 to control the sight 100, as described above with reference to the raw signal. If the sensor 110 senses an inductive signal, this sensed raw signal may be compared against a threshold value to generate a position signal. In other words, the sensor 110 may sense a raw inductive signal and compare the amplitude or other characteristic of the raw signal against the threshold value. If the raw inductive signal exceeds the threshold, or satisfies other signal characteristics, then the sensor 110 outputs a position signal to indicate the output of the comparison, such as generating a logic "1", or HIGH position signal when the raw signal exceeded the threshold, and generating a logic "0", or LOW position signal when the raw signal did not exceed the threshold. The position signal generated by the sensor 110 may be a digital or an analog signal.

Various signal processing or filtering may optionally be included in the sensor 110, such as in the signal filter 120, or this processing may take place in other components of the sight 100. Such signal processing may include filtering the raw signal to eliminate a bouncing artifact caused when the magnifier 200 switches position, for example. This type of filtering is referred to as debouncing. Other filtering may include using an input from an accelerometer 130, which detects movement of the sight 100. For example, the sensor 110 may suppress changing the position signal when the accelerometer 130 detects the firearm is discharged, which could otherwise cause the sensor 110 to generate an invalid position signal. Further, the output of the accelerometer 130 could be used to turn off the sensing function of the sensor 110 when the firearm has not moved longer than a preset duration. This can save battery power during times of non-use. The duration may be controllable by the user through the user inputs 180. In a typical embodiment, the signal from the accelerometer 130 is used in conjunction with an output signal of the sensor 110 as described above. But it is not necessary that both the accelerometer 130 and sensor 110 components be used in conjunction. Instead, either signal from the accelerometer 130 or the sensor 110 may be used to send a sensor signal, which may be a position signal, to the microprocessor 140 to control operation of the sight 100.

Figure 5:
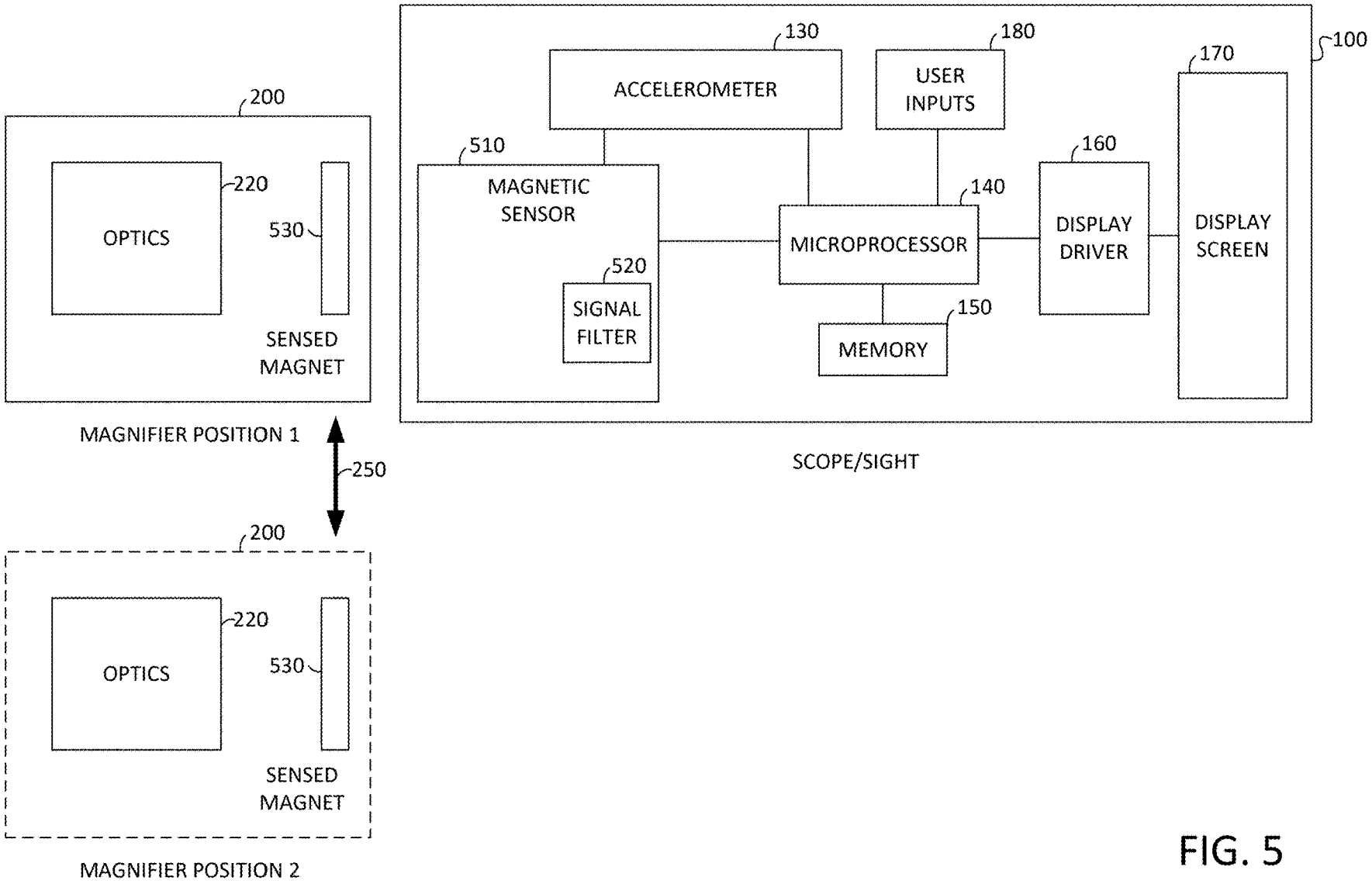
FIG. 5 is a block diagram illustrating example components of a target scope with sensor according to embodiments of the invention.

FIG. 5 illustrates another type of sensor that may be used in embodiments of the invention. In this embodiment it is a magnetic sensor 510 that senses the local presence (or absence) of a magnet 530 contained within or on the magnifier 200. In other embodiments the magnet 530 to be sensed could be integrated into or mounted on the mount 210 (FIG. 2). Any filtering of the magnet sensor may be performed by a signal filter 520. The remainder of the components illustrated in FIG. 5 operate the same or similar to those as described with reference to FIG. 4. In operation, the system of FIG. 5 operates the same as described above with reference to FIG. 4, but based on a magnetic sense signal rather than an inductive sense signal. When the magnifier 200 is in Position 2, the magnetic sensor 510 senses that the magnet 530 in the magnifier or mount 210 has changed positions and is no longer in the line of sight 102 (FIG. 3B) of the sight 100, and the sight 100 may change configuration based on such a change. Then, when the magnifier 200 is moved back to Position 1, the magnetic sensor 510 determines that the magnifier is within the line of sight 102 of the sight 100 (FIG. 3A), and sends a signal to the microprocessor 140 indicating this presence. The microprocessor 140, in turn, modifies the operation of the sight based on the presence of the magnifier in Position 1. Also as described above, a signal from the accelerometer 130 may be used in conjunction with, or instead of, the signal from the magnetic sensor 510 so that the sight 100 accurately determines the position of the magnifier.

Figure 6:
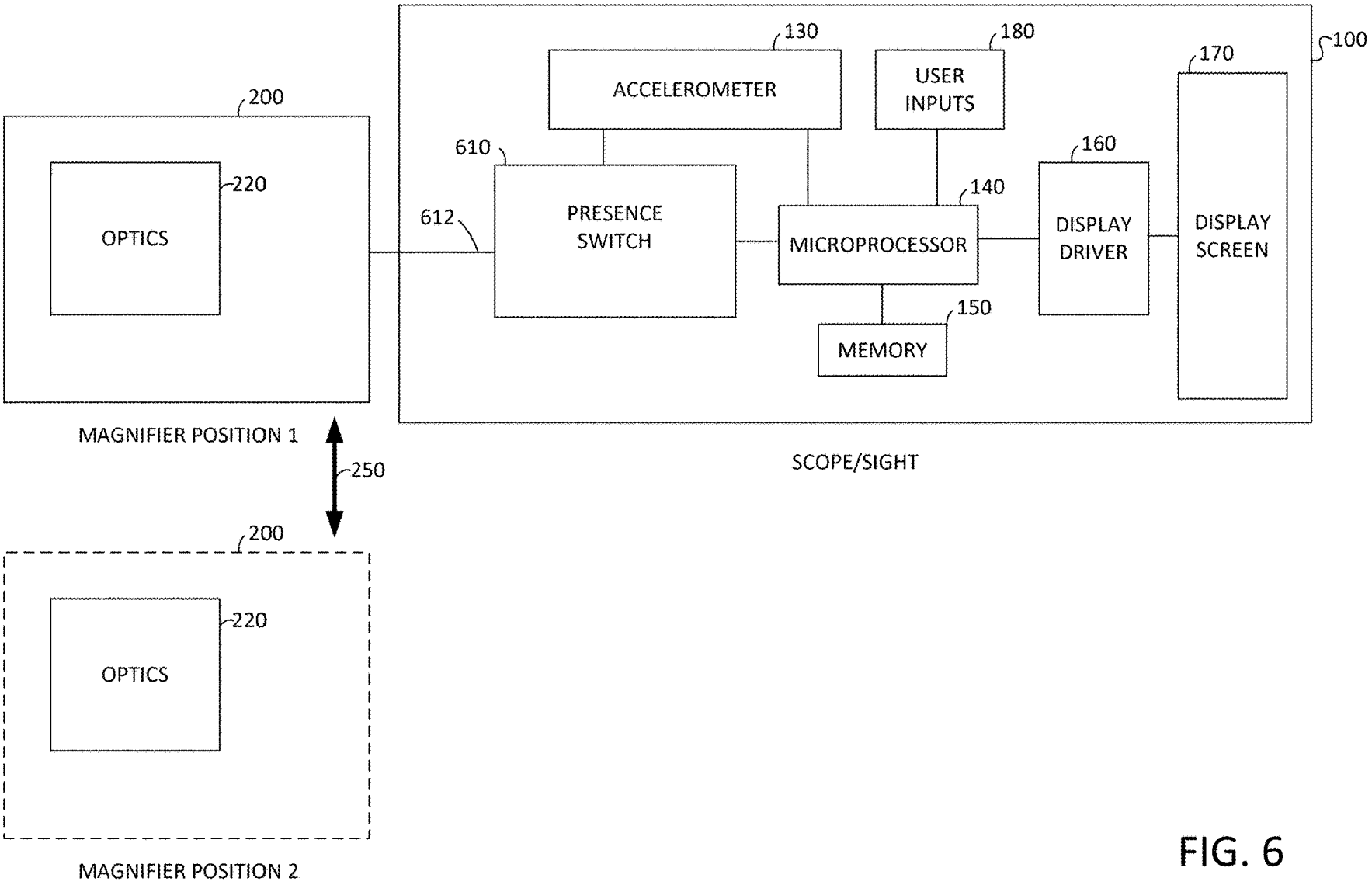
FIG. 6 is a block diagram illustrating example components of a target scope with sensor according to embodiments of the invention.

FIG. 6 illustrates yet another system to detect the presence of the magnifier 200 in the line of sight of the sight 100, which uses a switch 610. The switch 610 may be any type of switch, such as a mechanical switch, which is physically depressed when the magnifier 200 is in position 1. The switch may be part of the mount 210 (FIG. 2), part of the sight 100, part of the magnifier 200, or positioned elsewhere. In one embodiment the switch 610 is closed when the magnifier 200 is in Position 1 and open when the magnifier is in Position 2. In other embodiments the switch 610 is open when the magnifier 200 is in Position 1 and closed when the magnifier is in Position 2. The switch 610 may be physically connected to a position under or near the magnifier 200 through an electrical connection 612. The switch 610 may be alternatively connected to the mount 210. In other embodiments, the switch may be a wireless switch located on or near the rail to which the magnifier attaches and sends a wireless signal to the sight 100 indicating presence or absence of the magnifier 200 within the line of sight 102. In operation, the system of FIG. 6 operates the same as described above with reference to FIGS. 4 and 5. When the magnifier 200 is in Position 2, the switch 610 sensor senses that the magnifier 200 is not within the line of sight 102 of the sight 100. Then, when the magnifier 200 is moved to Position 1, the switch 610 determines that the magnifier is within the line of sight 102 of the sight 100, and sends a signal indicating this presence to the microprocessor 140, which may modify the operation of the sight based on the presence of the magnifier in Position 1, as described above.

Figure 7:
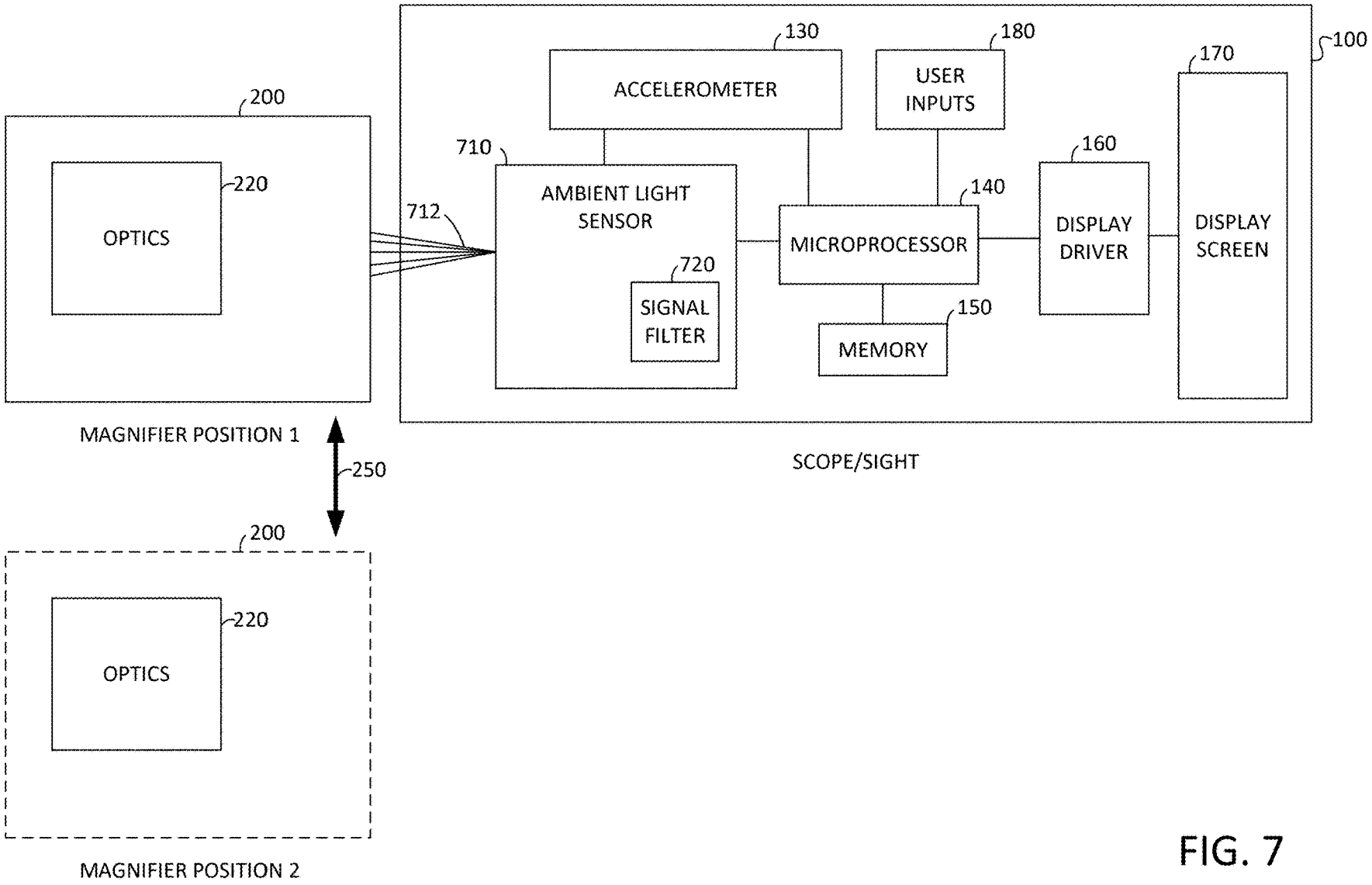
FIG. 7 is a block diagram illustrating example components of a target scope with sensor according to embodiments of the invention.

FIG. 7 illustrates yet another system to detect the presence of the magnifier 200 in the line of sight of the sight 100, which uses an ambient light sensor 710 to detect an amount of ambient light adjacent the sight 100 in an area 712. The area 712 may be an area between the sight 100 and the magnifier 200. When the magnifier 200 is in Position 1, the amount of ambient light sensed by the ambient light sensor 710 in the area 712 is reduced because this area is occluded by the magnifier. The amount of light sensed by the ambient light sensor 710 may be compared against a threshold to determine that the magnifier 200 has changed positions. Or the amount of light sensed by the ambient light sensor 710 may be compared against the amount of light sensed immediately preceding the change, such as an average sensed light value. Then, when the light value sensed by the ambient light sensor 710 suddenly increases, the ambient light sensor generates a new position signal and sends it to the microprocessor 140. Similarly, when the magnifier 200 is moved to Position 2, the ambient light sensor 710 senses more light compared to when the magnifier 200 was in Position 1. Filtering may be provided by a signal filter 720 to improve accuracy of the ambient light sensor 710. The remainder of the components in the sight 100 operate as described above.

Figure 8B:
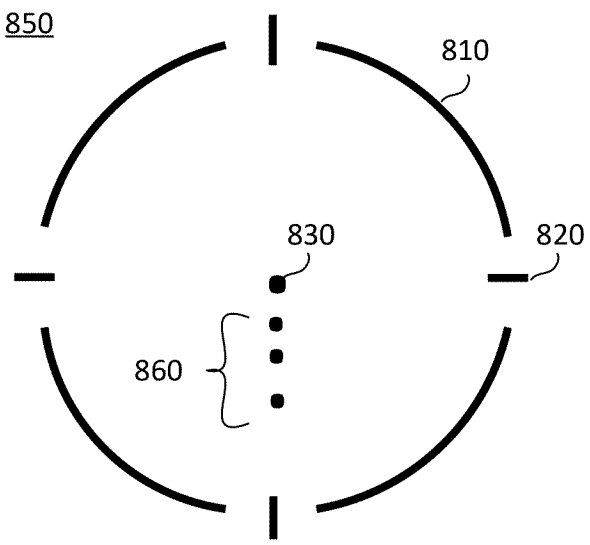
FIGS. 8A and 8B illustrate example reticles that may be changed in a sight based on the presence, proximity, or position of an accessory, according to embodiments of the invention.
Figure 8A:
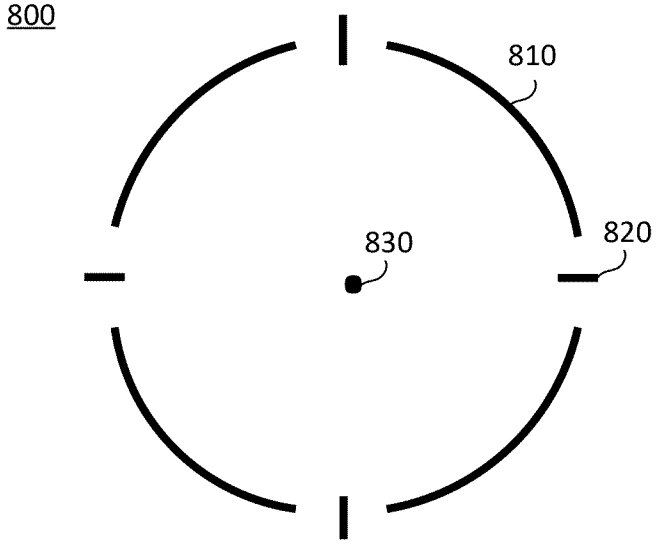

FIGS. 8A and 8B illustrate example reticles 800, 850, that may be appear in a sight based on the presence, proximity, or position of an accessory, according to embodiments of the invention. In general, reticles 800 and 850 illustrate example reticles in a sight, such as the sight 100 of FIG. 4. In other words, reticles 800, 850, are displayed, projected, reflected, or otherwise appear within the sight 100 when the shooter is aiming at a target. In this example, reticle 800 includes four circular portions 810, four truncated crosshair portions 820, and a center dot 830. The reticle 800 may be presented in a sight 100, for instance, when an accessory, such as a magnifier, is disengaged, and the shooter is viewing the target directly through the sight. The reticle 800 is presented in the sight 100 to provide a Point of Aim (PoA) to the target for the shooter. The reticle 800 is has a circle-dot configuration. The reticle 800 may be presented at a brightness controlled by the user.

The reticle 850 of FIG. 8B illustrates another reticle, such as that shown within the sight 100 when a magnifier, such as the magnifier 200, is positioned to be within the line of sight 102 (FIG. 3A) of the sight 100. The reticle 850 is similar to the reticle 800 of FIG. 8A, but further includes a series of holdover dots 860. Each of the individual holdover dots 860 presents a different PoA for targets having distances further from the shooter-exactly the type of information that a shooter may desire when using a magnifier 200. In embodiments of the invention, the sight 100 automatically changes from a first reticle, such as the reticle 800, when an accessory, such as the magnifier 200, is positioned to be within the line of sight 102 of the reticle to a second reticle, such as the reticle 850. The sight 100 makes the change in reticles based on sensing the change in presence, proximity, or position of the accessory, without any additional control or input from the shooter, as described above.

Further, either separately, or coincident with changing reticles, the sight 100 may also change a brightness setting of its present reticle, such as either the reticle 800 or 850, as the accessory changes position. For example, a shooter is viewing a target through the sight 100 that is displaying reticle 800 of FIG. 8A, but then desires to see a magnified view for a target further away. So, the user moves the magnifier 200 into its operating position, which is within the line of sight 102 of the sight 100. In response this change in position, a sensor, which can be any of the sensors or switch described above, determines that the magnifier 200 has been placed within the line of sight 102 of the sight 100. Next, the sight 100 automatically changes the reticle presented in the sight from the reticle 800 to the reticle 850, which is better suited for distant targets, as described above. Additionally, the sight 100 decrease the brightness of the reticle 850 to less than the brightness when the original reticle 800 was being displayed. This automatic decrease in brightness accounts for the fact that the view may be brighter to the user when using the magnifier 200 than when not using the magnifier.

In certain embodiments, the user may pre-program the sight 100 for various operation depending on the sensed condition of the sight, such as the presence, proximity, or position of an accessory. For example, the user may use the user interface 180 (FIG. 4) to configure the sight 100 to select the reticle 800 as the preferred reticle when using the sight 100 without magnification by the magnifier 200, and to select the reticle 850 as the preferred reticle when using the sight with magnification by the magnifier. The user may also set preferred brightness levels for each of the reticles. Or, in other embodiments, the user may indicate that the brightness level decreases by a set amount when the magnifier is used compared to when it is not being used. For example, the user may pre-define that the brightness level of the sight is decreased by 2 brightness steps when the sight 100 is being used in conjunction with the magnifier 200. With such pre-configuration, when the user positions the magnifier 200 to be out of the line of sight 102 of the sight, such as illustrated in FIG. 3A, the sight 100 automatically displays the reticle 800, which effectively removes off the holdover dots 360 from the reticle 850, going back to the circle-dot configuration of reticle 800, and the brightness of the reticle 800 automatically increases by two brightness steps, all based on input from the sensor of the sight, and without any further input from the user. Then, the next time the magnifier 200 is engaged, the sight changes back to reticle 850, which includes the holdover dots 360, and decreases the brightness by two brightness steps back to its original brightness setting. In another example, the sight 100 automatically decreases the brightness level of the sight 100 when a night vision accessory is initiated. Of course, these example are but a few examples of how the sight 100 may be configured to operate, and other methods of using the sensors within the sight 100 to automate control of the sight 100 depending on the presence, proximity, or position of an accessory are possible.

Figure 9:
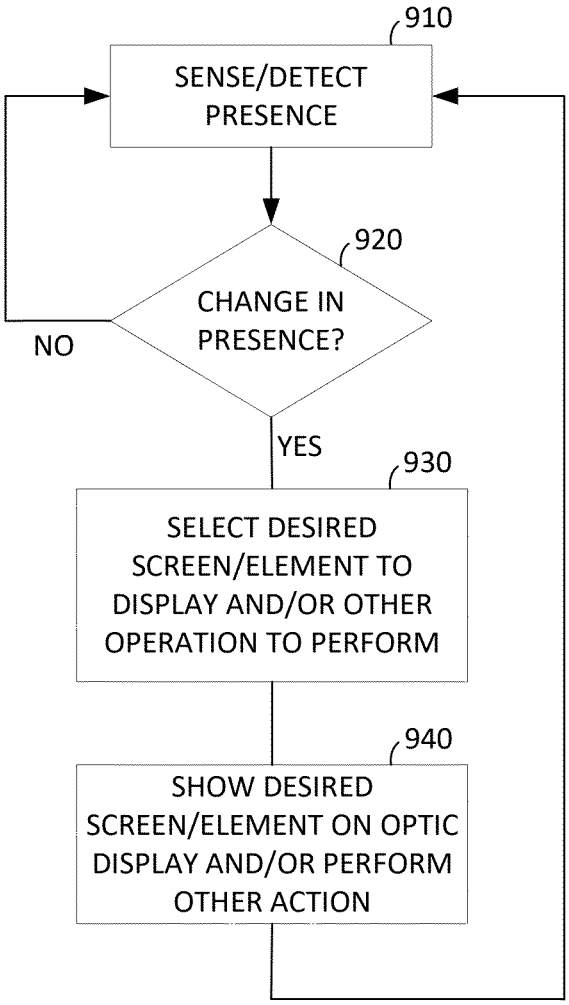
FIG. 9 is a flow diagram illustrating example operations of the target sight system of FIGS. 3-7, according to embodiments.

FIG. 9 is a flow diagram illustrating example operations in a flow 900 performed by the target sight system described above, according to embodiments. The flow 900 begins at an operation 910, where a sensor on a sight, such as the sight 100 described above, senses or detects the presence, proximity, or position of an accessory, such as the magnifier 200 described above. In some embodiments sensing the presence includes sensing the proximity of the magnifier 200. In other embodiments sensing the presence includes using an inductive or magnetic sensor to sense movement of a sensed component of the magnifier 200, such as a metal or magnetic component. In yet other embodiments the sensor detects changes in ambient light. In yet further embodiments, the state of a switch changes based on the position of the magnifier 200.

The sensor or switch in the sight 100, perhaps in combination with other components in the sight, such as the accelerometer 130, detects whether there has been a change in presence, proximity, or position, of the magnifier 200, in an operation 920. If there is no change in position, the operation 920 exits in the NO direction, and the presence is sensed again. In some embodiments, the operations 910 and 920 are effectively combined, and a sensor or switch in the sight 100 generates a signal only when the magnifier 200 is repositioned.

If there is a change in presence, the operation 920 exits in the YES direction. Once the change in presence, or position, is sensed, or determined, the sight 100 can take any action based on this change. In the illustrated embodiment, the sight 100 selects a particular display, such as a reticle, from two or more possible displays, in an operation 930. As described above, selecting a particular display may include providing an address of a reticle or indicator stored in memory. An operation 940 then shows the selected reticle or element on the sight 100 itself. The sight 100 could also display or remove an indicator on the display screen based on the changed position, such as an indicator of the position of the magnifier 200. Yet further, the sight 100 could perform another operation based on the position of the magnifier, such as brightening or dimming the display, or elements of the display.

In a simple example, the operation 920 senses that the magnifier 200 has been moved into the line of sight 102 of the sight 100. Then the operation 930 selects the reticle appropriate for using the magnifier 200 in conjunction with the sight 100, and the selected reticle is shown on the display screen 170 of the sight 100. Then, when the magnifier 200 is moved out of the line of sight 102 of the sight 100, the previous reticle may be re-selected, in the operation 930, and the original reticle is again shown on the display 170 in the operation 940. As described above, a sight 100 that includes embodiments of the invention may automatically cause the sight 100 to select an appropriate reticle based on the position of the magnifier 200. Also, as described above, the sight 100 may take any action based on the position of the accessory. Embodiments of the invention are not limited to merely switching reticles or screens based on the accessory position, but instead may modify any function of the sight 100 is capable of performing.

Although described above with detecting an accessory in one of two positions, embodiments of the invention may be used to detect multiple positions of the accessory. Further, as described above, the element sensed by the sensor or switch may be located within or on the accessory itself, or on a mount that holds the accessory, or in any location that allows detection by the sensing element or switch of the sight. In yet other embodiments, any of the proximity sensor 110, magnetic sensor 510, ambient light sensor 710, or the presence switch 610 may be housed in the sight 100, magnifier 200, or the mount 210, and send the resultant position change signal to the sight 100 when the magnifier changes position.

The previously described versions of the disclosed subject matter have many advantages that were either described or would be apparent to a person of ordinary skill. Even so, all of these advantages or features are not required in all versions of the disclosed apparatus, systems, or methods. All features disclosed in the specification, and all the steps in any method or process disclosed, may be combined in any combination, except combinations where at least some of such features and/or steps are mutually exclusive. Each feature disclosed can be replaced by alternative features serving the same, equivalent, or similar purpose, unless expressly stated otherwise.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," "left," "upward," and "downward" are used for convenience and in reference to the views provided in figures. But the target sight and components thereof may have a number of orientations in actual use. Thus, a feature that is vertical, horizontal, to the right, or to the left in the figures may not have that same orientation or direction in actual use.

All features disclosed in the specification, including any claims, abstract, and drawings, and all the steps in any method or process disclosed, may be combined in any combination, except combinations where at least some of such features and/or steps are mutually exclusive. Each feature disclosed in the specification, including any claims, abstract, and drawings, can be replaced by alternative features serving the same, equivalent, or similar purpose, unless expressly stated otherwise.

The invention claimed is:

1. An accessory system for a firearm, comprising:

a target sight structured to be secured to the firearm, the target sight including an accessory mount position sensor; and an accessory mount structured to be secured to the firearm, the accessory mount operable to be placed in a first physical position and a second physical position relative to the target sight;

wherein the accessory mount position sensor of the target sight is a physical switch structured to generate a signal when the accessory mount is moved between the first physical position and the second physical position relative to the target sight.

2. The accessory system for a firearm according to claim 1, in which the accessory mount is structured to secure a firearm accessory to the firearm.

3. The accessory system for a firearm according to claim 2, in which the firearm accessory is a second target sight, a light, a laser, a night-vision sight, a night-vision scope, or a magnifier.

4. The accessory system for a firearm according to claim 1, further comprising a processor in the target sight structured to receive input from the accessory mount position sensor and adjust an operating mode of the target sight based on the received input.

5. The accessory system for a firearm according to claim 4, further comprising an accelerometer.

6. The accessory system for a firearm according to claim 5, in which the processor is configured to further receive input from the accelerometer, and the processor is configured to adjust the operating mode of the target sight based on the input from the accessory mount position sensor and from the accelerometer.

7. The accessory system for a firearm of claim 4, in which the target sight includes two or more pre-stored operating modes.

8. The accessory system for a firearm of claim 7, in which the two or more pre-stored operating modes comprise displaying a reticle of the target sight at a first brightness level and displaying the reticle of the target sight at a second brightness level.

9. The accessory system for a firearm of claim 7, in which the two or more pre-stored operating modes comprise selecting and displaying a first reticle from a plurality of available reticles for display on the target sight and selecting and displaying a second reticle from the plurality of available reticles for display on the target sight.

10. The accessory system for a firearm according to claim 1, in which the accessory mount position sensor is structured to sense a component mounted to or integrated into the accessory mount.

11. The accessory system for a firearm according to claim 10, in which the component is a magnet and in which the accessory mount position sensor is a magnetic sensor.

12. The accessory system for a firearm according to claim 10, in which the component is made of metal and in which the accessory mount position sensor is an inductive sensor.

13. The accessory system for a firearm according to claim 10, further comprising an accessory mounted to the accessory mount, and in which the component is included in or carried by the accessory.

14. The accessory system for a firearm according to claim 1, in which the accessory mount position sensor is an ambient light sensor.

15. A method of operating a target sight having an accessory mount position sensor, the method comprising:

sensing a change in physical proximity of a component of an accessory mount when the accessory mount is physically moved between a first physical position and a second physical position relative to the target sight, including:

generating a signal from a sensor in the target sight based on the physical movement of the accessory mount, comparing the sensor signal to a threshold, and producing a mode change signal based on the comparison of the sensor signal to the threshold; and responsive to the mode change signal, changing an operating mode of the target sight.

16. The method of operating a target sight according to claim 15, in which generating a signal from a sensor comprises generating a signal from a magnetic sensor.

17. The method of operating a target sight according to claim 15, in which generating a signal from a sensor comprises generating a signal from an inductive sensor, a light sensor, a proximity sensor, or a switch.

18. The method of operating a target sight according to claim 15, in which changing an operating mode of the target sight comprises selecting a different mode from a plurality of operating modes pre-stored in the target sight.

19. The method of operating a target sight according to claim 18 in which the operating modes pre-stored in the target sight includes displaying one of a plurality of reticles pre-stored in the target sight or displaying one of a plurality of brightness levels pre-stored in the target sight.

20. An accessory system for a firearm, comprising:

a target sight structured to be secured to the firearm, the target sight including an accessory mount position sensor; and an accessory mount structured to be secured to the firearm, the accessory mount operable to be placed in a first physical position and a second physical position relative to the target sight;

wherein the accessory mount position sensor of the target sight is structured to sense a component mounted to or integrated into the accessory mount and to generate a signal when the accessory mount is moved between the first physical position and the second physical position relative to the target sight, and in which (i) the component is a magnet and the accessory mount position sensor is a magnetic sensor, or (ii) the component is made of metal and the accessory mount position sensor is an inductive sensor.

21. The accessory system for a firearm according to claim 20, further comprising an accessory mounted to the accessory mount, and in which the component is included in or carried by the accessory.

22. The accessory system for a firearm according to claim 20, further comprising a processor in the target sight configured to receive input from the accessory mount position sensor and adjust an operating mode of the target sight based on the received input.

23. The accessory system for a firearm according to claim 22, further comprising an accelerometer, and in which the processor is configured to further receive input from the accelerometer, and the processor is configured to adjust the operating mode of the target sight based on the input from the accessory mount position sensor and from the accelerometer.

24. The accessory system for a firearm of claim 22, wherein:

the target sight includes two or more pre-stored operating modes which include at least: (i) displaying a reticle of the target sight at a first brightness level, and (ii) displaying the reticle of the target sight at a second brightness level; and the processor is configured to adjust the operating mode by selecting from the pre-stored operating modes based on the received input from the accessory mount position sensor.

25. The accessory system for a firearm of claim 22, wherein:

the target sight includes two or more pre-stored operating modes which include at least: (i) displaying a first reticle from a plurality of available reticle patterns stored on the target sight, and (ii) displaying a second reticle from the plurality of available reticle patterns; and the processor is configured to adjust the operating mode by selecting from the pre-stored operating modes based on the received input from the accessory mount position sensor.

* * * * *